United States Patent [19]

Guntly et al.

[11] Patent Number: 4,679,534

[45] Date of Patent: Jul. 14, 1987

[54] PRIMER FOR FLOAT-TYPE CARBURETORS

[75] Inventors: Thomas G. Guntly, Hartford; Curtis L. Schultz, Grafton, both of Wis.

[73] Assignee: Tecumseh Products Company, Tecumseh, Mich.

[21] Appl. No.: 833,350

[22] Filed: Feb. 25, 1986

[51] Int. Cl.[4] ..... F02M 1/16

[52] U.S. Cl. ..... 123/187.5 R; 92/92; 261/DIG. 8

[58] Field of Search ..... 123/187.5 R; 261/DIG. 8; 92/92

[56] References Cited

U.S. PATENT DOCUMENTS

| | | | |
|---|---|---|---|
| 2,615,379 | 10/1952 | Groff | 92/92 |
| 3,170,006 | 2/1965 | Brown | 261/69 |
| 3,275,305 | 9/1966 | Nutten | 261/34 |
| 3,281,129 | 10/1966 | Payne | 261/34 |
| 3,307,836 | 3/1967 | Arndt et al. | 261/34 |
| 3,323,293 | 6/1967 | Santi | 55/385 |
| 3,338,565 | 8/1967 | Heid | 261/70 |
| 3,345,045 | 10/1967 | Tuggle | 261/34 |
| 3,430,933 | 3/1969 | Taggart | 123/187.5 R |
| 3,451,383 | 6/1969 | Nelson | 123/187.5 |
| 3,494,343 | 2/1970 | Nutten | 123/187.5 |
| 3,780,996 | 12/1973 | Nutten | 261/72 |
| 3,978,839 | 9/1976 | Du Bois et al. | 123/187.5 R |
| 3,985,113 | 10/1976 | Du Bois et al. | 123/187.5 R |
| 4,197,825 | 4/1980 | Altenbach | 123/187.5 R |
| 4,203,405 | 5/1980 | Shultz et al. | 123/187.5 R |
| 4,228,110 | 10/1980 | Magnet | 261/37 |
| 4,271,093 | 6/1981 | Kobayashi | 261/34 R |
| 4,323,522 | 4/1982 | Rasmussen | 261/72 R |
| 4,335,061 | 6/1982 | Kobayashi | 261/44 G |
| 4,404,933 | 9/1983 | Kuczenski | 123/187.5 R |

FOREIGN PATENT DOCUMENTS

| | | | |
|---|---|---|---|
| 389197 | 2/1924 | Fed. Rep. of Germany . | |
| 789433 | 1/1958 | United Kingdom . | |
| 888432 | 1/1962 | United Kingdom | 123/187.5 R |

*Primary Examiner*—Andrew M. Dolinar

*Attorney, Agent, or Firm*—Jeffers, Irish & Hoffman

[57] ABSTRACT

A primer for an internal combustion engine carburetor including a variable volume air chamber which is provided with a flexible resilient dome member. The dome member includes a protruding nipple including an aperture therein for admitting air into the chamber. Inside the chamber, a protrusion is provided including a sloping surface with an aperture therein. A passage connects the aperture in the sloping surface to the fuel supply bowl. When an operator abruptly depresses the flexible resilient dome member, a volume of air is abruptly displaced from the chamber through the passage and into the fuel supply bowl to force fuel from the bowl through a nozzle and into a fuel/air mixture passageway of the carburetor.

11 Claims, 6 Drawing Figures

PRIMER FOR FLOAT-TYPE CARBURETORS

BACKGROUND OF THE INVENTION

This invention relates to carburetors for supplying a combustible fuel/air mixture to internal combustion engines and more specifically to a primer mechanism for such carburetors. Even more specifically, the present invention relates to a manually operable primer for supplying an initial charge of fuel to an engine to aid in starting the engine.

In small internal combustion engines, particularly those engines which are started by hand cranking, it is frequently desirable to provide a priming arrangement for introducing a fuel charge into the engine intake system to aid in starting the engine. Such priming arrangements are particularly desirable for internal combustion engines which are used in snow throwers, lawn mowers, and the like. Numerous priming systems have been marketed or have been illustrated in the patent literature.

Known priming arrangements are typically in the form of an operator actuated priming bulb which, when depressed, displaces a volume of air into a carburetor float bowl or fuel well to displace fuel from the carburetor float bowl or fuel well into the engine intake system. Such arrangements are illustrated, for example, in U.S. Pat. Nos. 4,203,405, and 4,404,933. U.S. Pat. No. 4,203,405 discloses a well priming arrangement wherein fuel is displaced from the well of the carburetor. U.S. Pat. No. 4,404,933 discloses a float bowl priming arrangement for displacing fuel from the fuel bowl. Priming bulbs with protruding nipples have been used in conjunction with diaphragm carburetors.

A problem with well priming systems is that, after a priming operation, fuel is only slowly replaced in the well. Therefore, if the operator attempts to prime the engine in rapid succession, no fuel is present in the well after the first priming operation so that the only effective priming operation is the first priming operation. Furthermore, each prime is limited to the volume of the well, which is quite small compared to the bowl. In the present invention, which is a bowl priming system, since the primer bulb is external to the carburetor, it can have a large volume thereby permitting concomitantly large primes with each depression. Since bowl priming systems are not susceptible to this problem, it is desired to provide a bowl type of priming system.

Prior art priming arrangements have been provided which are internally vented whereby the displaced air is replaced with air drawn from the interior of the engine. A disadvantage of internally and externally vented priming arrangements is that part of the displaced air is lost through the vent passage rather than performing useful work in displacing fuel from the bowl or the well into the carburetor throat and thereby reducing the effectiveness of the priming arrangement. Another problem with internally vented primer systems has been that calibration of the carburetor has been difficult to achieve due to bowl vacuum because of the small bowl vent.

Externally vented priming arrangements have also been provided in the prior art. However, a disadvantage of these externally vented priming arrangements has been that contaminant dirt and water particles in the ambient air which are drawn into the priming chamber have tended to contaminate the external vent aperture and the air passages, thereby clogging the aperture and preventing or hindering the priming ability of the arrangement. This also causes gravity feed of fuel through the carburetor.

It is, therefore, desired to provide a priming arrangement for an internal combustion engine wherein the vent aperture and air passages are not subject to contamination by water or dirt so that the priming mechanism will remain effective throughout the life of the engine.

SUMMARY OF THE PRESENT INVENTION

The present invention overcomes the disadvantages of the prior art priming arrangements by providing an improved priming arrangement therefor.

The priming arrangement of the present invention, in one form thereof, provides a variable volume primer chamber in a carburetor body and an operator actuable displacing means for abruptly displacing a discreet volume of air from the chamber. A generally downwardly sloping surface having an aperture therein is provided in the chamber. The aperture in the sloping surface is connected by means of a passageway to the fuel supply bowl.

The primer arrangement of the present invention, in one form thereof, includes a carburetor body having a fuel/air mixing passageway and a priming chamber. One wall of the primer chamber is formed by a flexible, resilient dome which includes a vent or air admitting aperture for admitting air into the chamber. The chamber includes a protrusion with a sloping surface and having an aperture therein. A passage connects the aperture in the sloping surface to the fuel supply bowl. When an operator depresses the flexible, resilient dome, a volume of air is displaced from the chamber through the passage and into the fuel supply bowl whereby fuel is forced from the bowl through a nozzle into the fuel/air mixture passageway of the carburetor. An advantage to a vented bulb primer is that even slow depression of the bulb will displace fuel, whereas in vented bowl primers, an abrupt depression of the bulb is necessary.

One advantage of the present invention is that the vent or air admitting inlet in the flexible, resilient dome is at right angles to the aperture for admitting air into the passageway whereby heavier than air, water and dirt particles will tend to drop out of the admitted air and will not contaminate and tend to clog the air passageway aperture.

Another advantage of the present invention is that the contour of the sloping surface in the chamber aids in shedding water and dirt particles rather than permitting those particles to be deposited around the passageway aperture inlet.

A further advantage of the present invention is that the passageway extends through the sloping surface thereby forming an elliptical aperture. The elliptical aperture permits liquid water to drain through the passage rather than permitting the liquid to bridge across the aperture and preventing air from flowing from the primer chamber into the air passage.

Yet another advantage of the present invention is that the air passage aperture in the sloping surface is located in an upper portion of the primer chamber, thereby minimizing collection of dirt and water particles around the passage.

Still another advantage of the present invention is that the flexible, resilient dome is provided with a nipple which prevents the collection of contaminants in the vent opening as each time the operator actuates the bulb, such actuation will tend to dislodge dirt from the aperture thereby preventing clogging of the vent aperture.

A yet further advantage of the present invention is that it is effective yet is simple in construction and economical to manufacture.

The present invention, in one form thereof, provides a primer for a carburetor. The carburetor provides a combustible fuel/air mixture to an internal combustion engine and includes a carburetor body, a fuel/air mixture passage, a fuel supply bowl, and a fuel nozzle for conducting fuel from the fuel supply bowl to the fuel/air mixture passage. The primer includes a primer chamber located in the carburetor body and an operator actuated displacing means for abruptly displacing a discrete volume of air from the chamber. The displacing means includes an aperture for admitting air from outside the carburetor body to the chamber. A generally downwardly sloping surface is arranged in the chamber and includes an aperture. A passageway extends from the aperture in the sloping surface to the fuel supply bowl.

The present invention, in one form thereof, further comprises a carburetor for providing a combustible fuel/air mixture to an internal combustion engine. The carburetor includes a carburetor body, a fuel/air mixture passage, a fuel supply bowl, and a fuel nozzle for conducting fuel from the fuel supply bowl to the mixture passage. A primer arrangement is provided for the carburetor and comprises a variable volume air chamber in the carburetor body and a passageway extending from the chamber to the fuel supply bowl. A flexible dome member is provided for abruptly displacing a discrete volume of air from the chamber. The dome member includes a nipple which has a vent aperture therein for admitting air into the air chamber.

The present invention, in one form thereof, still further comprises a carburetor for providing a combustible fuel/air mixture to an internal combustion engine. The carburetor comprises a carburetor body and a fuel/air mixture passage. A float regulated fuel supply bowl and a fuel nozzle provide fuel to the mixture passage. A primer chamber is provided including a generally downwardly sloping surface therein. The generally downwardly sloping surface includes an aperture therein which is connected by means of a passageway to the fuel supply bowl. A flexible, manually operable dome is provided for abruptly varying the volume of the chamber to thereby force a discrete volume of air from the chamber through the passageway and into the bowl. The dome member includes a nipple which has a vent aperture therein for admitting air into the chamber to replace the displaced air.

It is an object of the present invention to provide a primer mechanism for an internal combustion engine carburetor which is effective and economical to construct.

It is another object of the present invention to provide a primer mechanism for an internal combustion engine carburetor wherein a primer chamber is provided including a sloped surface therein for aiding in shedding water and dirt particles which are introduced into the chamber.

It is yet another object of the present invention to provide a primer arrangement for a carburetor wherein the vent aperture for a variable volume chamber is oriented at substantially right angles to the aperture through which air is displaced from the chamber.

Still another object of the present invention is to provide a primer arrangement for a carburetor wherein the aperture through which air is displaced from the variable volume chamber is elliptical in shape.

A further object of the present invention is to provide a primer mechanism for a carburetor wherein the aperture whereby air is displaced from the chamber is located in an upper portion of the chamber to minimize dirt and water collection therein.

A yet further object of the present invention is to provide a carburetor primer arrangement wherein the flexible, resilient dome for displacing air from the primer chamber includes a nipple to prevent the collection of contaminants in the vent aperture.

BRIEF DESCRIPTION OF THE DRAWINGS

The above-mentioned and other features and objects of this invention and the manner of attaining them will become more apparent and the invention itself will be better understood by reference to the following description of an embodiment of the invention taken in conjunction with accompanying drawings, wherein.

Corresponding reference characters indicate corresponding parts throughout the several views of the drawings.

The exemplifications set out herein illustrate a preferred embodiment of the invention, in one form thereof, and such exemplifications are not to be construed as limiting the scope of the disclosure or the scope of the invention in any manner.

DESCRIPTION OF THE PREFERRED EMBODIMENT

Figure 1:
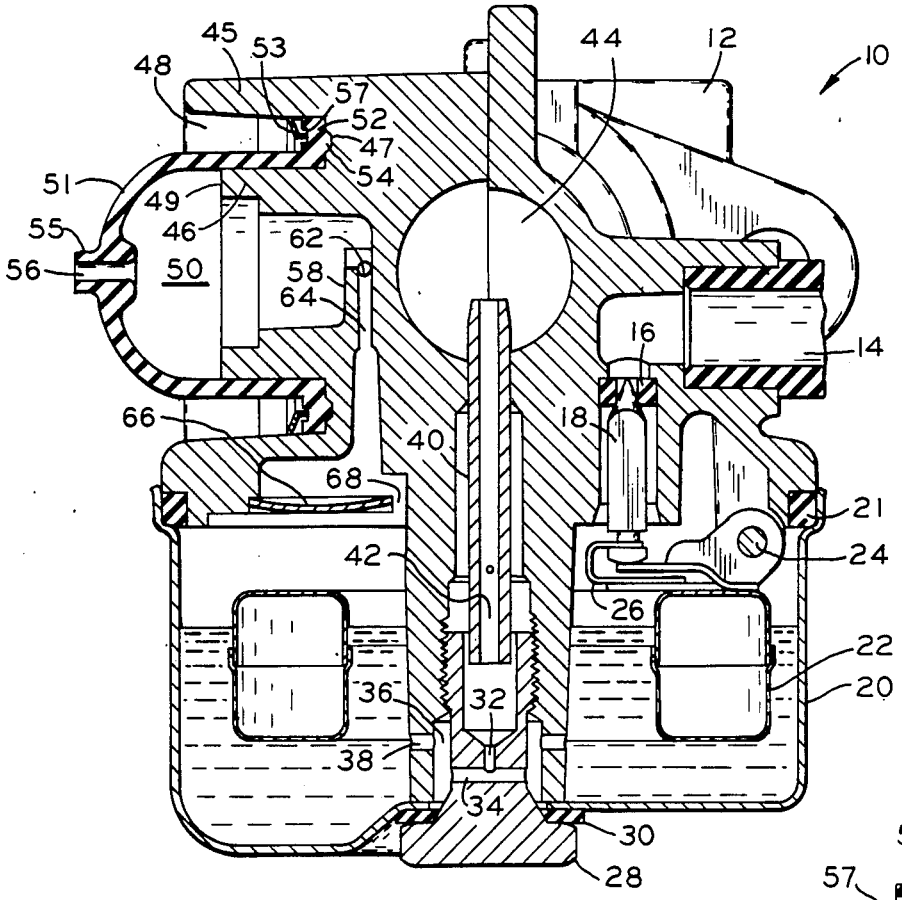
FIG. 1 is a cross sectional view of a preferred embodiment of the present invention.
Figure 2:
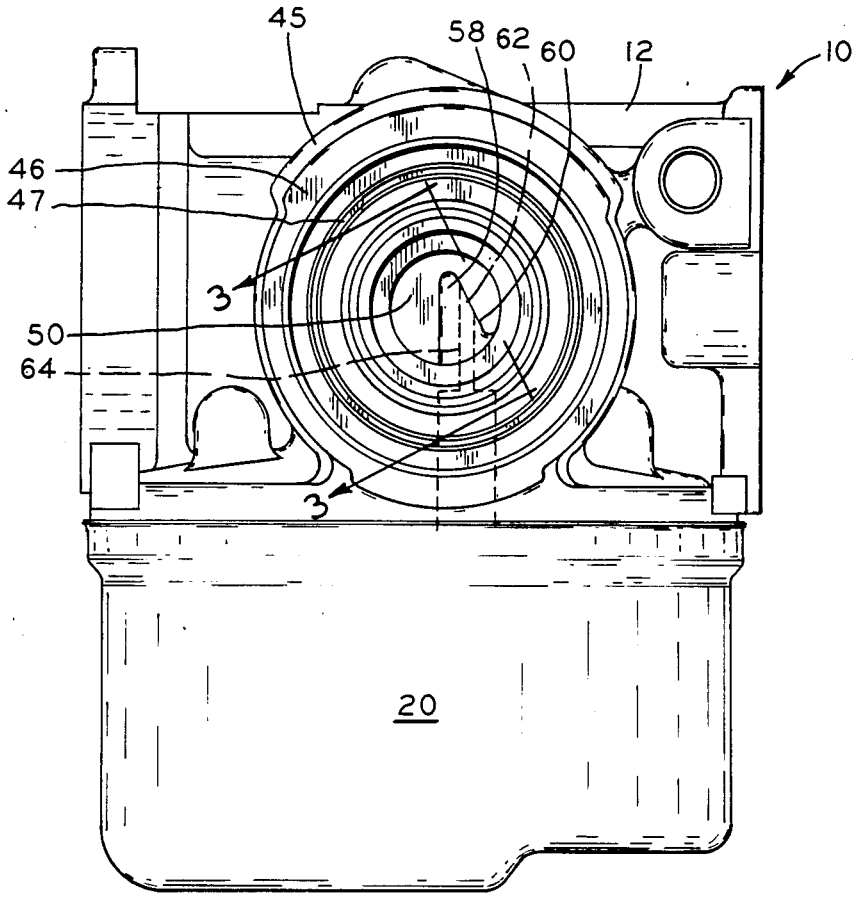
FIG. 2 is an elevational side view of the carburetor with the primer bulb removed and taken from the left side of FIG. 1.

Referring to FIGS. 1 and 2, a carburetor 10 is shown including a carburetor body 12 which may be formed of a suitable metal such as cast aluminum. The carburetor body includes a fuel inlet passage 14 for admitting fuel into the carburetor body. An inlet needle valve arrangement is shown including an inlet needle 18 and an inlet seat 16. A float bowl 20 is sealingly attached to the carburetor body 10 by means of an O-ring 21. A float 22 is pivotably supported on a float pivot pin 24. Float 22 is connected to inlet needle 18 by means of an inlet needle clip 26. Therefore, as fuel is admitted into fuel bowl 20, float 22 will pivot upwardly about pin 24 and carry inlet needle clip 26 and inlet needle 18 upwardly. Inlet needle 18, at a certain point in its upward movement, will close off the fuel inlet opening by seating on inlet seat 16. As fuel is used up so that the fuel level in fuel bowl 20 decreases, float 22 will pivot downwardly thereby unseating needle 18 from inlet seat 16 and to admit further fuel into fuel bowl 20.

Fuel bowl 20 includes an adapter nut 28 which is sealed to fuel bowl 20 by means of a sealing washer 30.

A series of fuel passages, 34, 36, and 38, connect a fuel metering passage 32 with the interior volume of fuel bowl 20. Fuel metering orifice 32 is also connected with a nozzle conduit 42 in nozzle 40 whereby fuel will be drawn upwardly by means of the lower pressure existing in the fuel/air mixing passageway or venturi 44. Thus, fuel will travel from bowl 20 through passages 38, 36, 34, fuel metering orifice 32, and nozzle conduit 42, into venturi 44. The fuel will be mixed with air in venturi 44. This mixture is then drawn into the engine (not shown).

Carburetor body 12 includes a pair of annular flanges 45 and 46 to form an annular space 48 therebetween. The bottom surface of annular space 48 includes a circular groove 47. The outermost surface of annular flange 46 comprises a prime bulb stop as further explained hereinafter. Carburetor body 12 also includes a variable volume primer chamber 50 which is closed off by means of a primer bulb 51 so that primer bulb 51 forms a wall portion for primer chamber 50.

Figure 4:
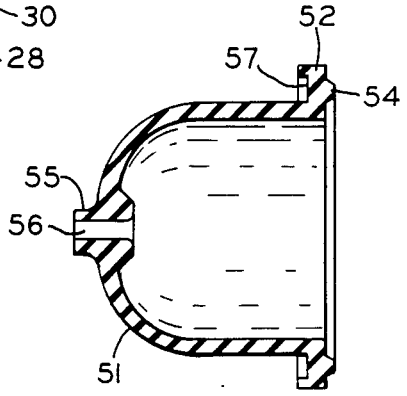
FIG. 4 is a cross sectional view of the primer bulb.
Figure 5:
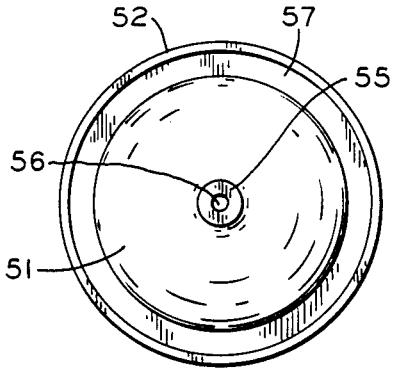
FIG. 5 is a side view of the primer bulb of FIG. 4.

Further referring to FIGS. 1, 4, and 5, primer bulb 51 includes a flange 52 for retaining primer bulb 51 in the annular space 48 by means of a primer bulb retainer ring 53. Retainer ring 53 is comprised of spring steel so that it may be deformed and pressed into annular space 48 to be retained therein by means of an interference fit. Retainer ring 53 seats in a groove 57 in primer bulb flange 52. Primer bulb flange 52 also includes an annular ring 54 which seats in the circular groove 47 of carburetor body 12. Thus, primer bulb 51 is assembled to carburetor body 12 by fitting flange 52 into annular space 48 and then forcing retainer ring 53 into flange groove 57. Primer bulb 51 is generally dome shaped and includes a nipple 55 which is provided with a vent or aperture 56. Thus, air may be admitted to primer chamber 50 by means of vent 56. Primer bulb 51 is preferably constructed of a flexible and resilient material such as a rubber material, for instance, nitrile, whereby the dome shaped primer bulb 51, upon depression, will resume its dome shape after an operator removes his finger from the primer bulb.

Figure 3:
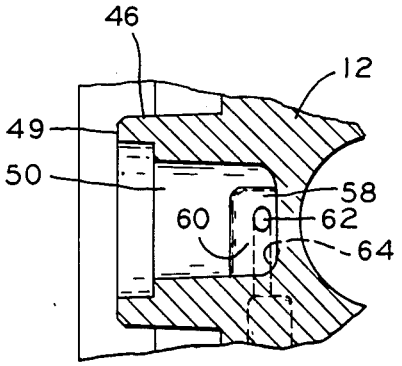
FIG. 3 is a cross sectional view taken along lines 3—3 of FIG. 2.

Referring now to FIGS. 1, 2, and 3, it can be seen that a generally vertically extending protrusion 58 is provided in chamber 50. Protrusion 58 includes a generally downwardly sloping surface 60. Surface 60 extends at an angle of approximately fifty-five to sixty-five degrees (55°–65°) with respect to the horizontal. An air passage 64 is provided in the carburetor body 12 for connecting the primer chamber 50 with the volume in fuel bowl 20. Passage 64 is cylindrical in shape and extends into chamber 50 through surface 58. Since passage 64 is generally vertical, the aperture formed in surface 58 is generally elliptical. This elliptical shape is advantageous since it is larger in area than the cross sectional area of passage 64 and thereby prevents water particles which may enter primer chamber 50 from bridging aperture 62 and therefore insures that passage 64 will not be blocked.

It should also be noted that, by providing a sloped surface 58, vertical passage 64 can directly connect chamber 50 with bowl 20, thereby simplifying manufacture of the priming arrangement. Furthermore, it should be noted that aperture 62 is oriented at right angles to vent aperture 56 thereby aiding in the settling out of particles of dirt and water which may enter chamber 50 through aperture 56 and further insuring that aperture 62 will not be clogged.

A splash shield 66 is also provided between aperture 62 and the fuel contained in bowl 20, so that no fuel in bowl 20 can splash upwardly through aperture 62. Splash shield 66 forms a tortuous passage 68 so that fuel splashing upwardly is blocked whereas air may travel downwardly through aperture 62 and passage 64 through tortuous passage 68 into fuel bowl 20.

Figure 6:
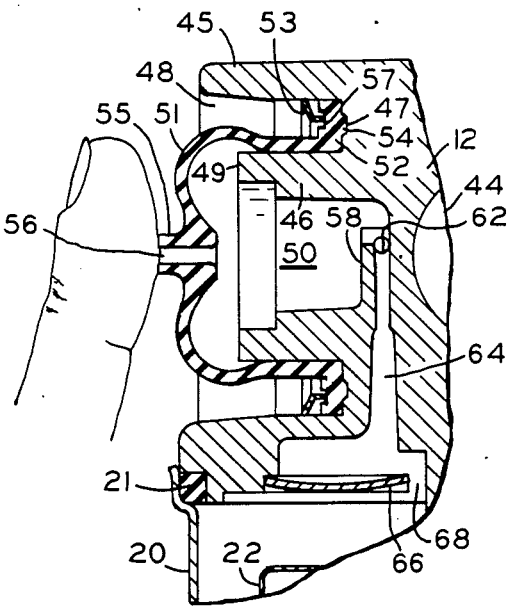
FIG. 6 is a broken away partial view of the primer mechanism of FIG. 1 with the primer bulb shown in its depressed state.

Referring now to FIGS. 1 and 6, the primer apparatus operates as follows. When it is desired to prime the engine, an operator places his finger on nipple 55 and presses rapidly inwardly thereby causing volume 50 to decrease and causing displacement of a volume of air from chamber 50 through aperture 62, passage 64, passage 68, and into fuel bowl 20. Bulb 51 bottoms out against primer bulb stop 49. The higher pressure generated by this displaced air volume in fuel bowl 20 causes fuel to flow through passages 38, 36 and 34 and orifice 32 into nozzle conduit 42 and causes the fuel to be forced into the venturi fuel/air mixture passage 44 to form a richer fuel/air mixture, thereby aiding in starting the engine. As the operator removes his finger from nipple 55, air will be admitted through vent 56 into primer chamber 50. The natural resiliency of primer bulb 51 will cause primer bulb 51 to assume its former undeformed dome shape as illustrated in FIG. 1. Nipple 55 acts as a contaminant shield so that, if any dirt or water is present on the operator's finger or on the bulb, the dirt or water will be rubbed off nipple 55 and will not be able to enter vent aperture 56. Each time the operator depresses primer bulb 51, he will wipe off nipple 55 thereby preventing contaminants from remaining on the nipple and preventing clogging of vent aperture 56. Furthermore, if any moisture collects on the primer bulb 51, the moisture will tend to drip down past the nipple 55 rather than remaining present around aperture 56. Therefore, the nipple construction has a substantial advantage of preventing dirt and water from collecting in aperture 56 and thereby causing possible clogging of aperture 56 and destroying the effectiveness of the vent aperture 56 and the primer structure. If any water or dirt particles enter aperture 56, they will tend to settle out due to the right angle orientation of aperture 56 with respect to aperture 62.

Sloping surface 60 effectively prevents articles such as dirt and water from blocking apertures 62 as any particles tending to collect on surface 60 will tend to slide downwardly from surface 60 and into the bottom portion of primer chamber 50. It should be noted that aperture 62 is located in the upper portion of chamber 50 to further reduce the possibility of collecting particles therein. Furthermore, the slope of surface 60 is steep enough, preferably in the range of fifty-five to sixty-five degrees (55°–65°), to prevent collection of particles on surface 58. Additionally, by providing passage 64 so that aperture 62 is located in the sloping surface 58, the aperture 62 will be oval or elliptically shaped and will be larger than the diameter of passage 64. By this arrangement, any particles entering chamber 50 will not tend to bridge aperture 62 and thereby will not tend to block passage 64.

Thus, a primer arrangement has been provided for a carburetor which is very simple and which is more effective than the prior art primer arrangements.

While this invention has been described as having a preferred embodiment, it will be understood that it is capable of further modification. This application is therefore intended to cover any variations, uses, or adaptations of the invention following the general principles thereof and including such departures from the present disclosure as come within known or customary practice in the art to which this invention pertains and fall within the limits of the appended claims.

What is claimed is:

1. A primer for a carburetor, said carburetor adapted to provide a combustible fuel/air mixture to a combustion engine and including a carburetor body, a fuel/air mixture passage, a fuel supply bowl, and a fuel nozzle means for conducting fuel from the fuel supply bowl to the mixture passage, said primer comprising:

a primer chamber in said carburetor body;

an operator actuable displacing means for abruptly displacing a discrete volume of air from said chamber, said displacing means including a vent aperture for admitting air from outside said carburetor body into said chamber;

a generally downwardly sloping surface in said chamber, said surface being oriented parallel to the direction of flow of air through said vent aperture, said surface including a priming aperture therein, said priming aperture being located intermediate the upper and bottom surfaces of said primer chamber;

a generally vertical surface in said chamber perpendicularly adjoining surface in said chamber perpendicularly adjoining said downwardly sloping surface; and a passageway extending from said priming aperture into said fuel supply bowl.

2. The carburetor of claim 1 wherein the aperture in said sloping surface is generally elliptical in shape.

3. The carburetor of claim 1 wherein said displacing means comprises a flexible resilient bulb member including a nipple, said vent aperture being located in said nipple.

4. The carburetor of claim 1 including a splash shield means in said carburetor body for preventing upward splashing of fuel from said fuel supply bowl into said passageway.

5. In a carburetor for providing a combustible fuel/air mixture to a combustion engine and including a carburetor body, a fuel/air mixture passage, a fuel supply bowl, and a fuel nozzle for conducting said fuel supply bowl to said mixture passage, a primer arrangement comprising:

a variable volume air chamber in said body;

a passageway extending from said chamber to said fuel supply bowl; and a flexible dome member for abruptly displacing a discrete volume of air from said chamber, said dome member including a nipple having a vent aperture therein for admitting air into said chamber, said chamber including a generally downwardly sloping substantially planar internal surface which is oriented substantially parallel to the axis of said admitting aperture in said nipple, said surface including a generally elliptical aperture in an upper portion of said chamber, said passageway extending vertically in a direction at sustantially right angles to the axis of said admitting aperture from said sloping surface to said fuel supply bowl.

6. The carburetor according to claim 5 wherein said dome member is resilient and forms a portion of the walls of the variable volume chamber, whereby the natural resilience of said dome member causes the variable volume chamber to return to its pre-displaced volume.

7. The carburetor of claim 5 including a splash shield means in said body for preventing fuel from splashing upwardly from said fuel supply bowl into said passageway.

8. A carburetor for providing a combustible fuel/air mixture to an internal combustion engine, said carburetor comprising:

a carburetor body;

a fuel/air mixture passage;

a float regulated fuel supply bowl;

a fuel nozzle for conducting fuel from said bowl to said mixture passage;

a primer chamber;

a protrusion in said primer chamber, said protrusion including a generally downwardly sloping outer surface and at least one generally vertical outer surface, said downwardly sloping surface including a priming aperture located above the bottom surface of said primer chamber;

a passageway connecting said priming aperture with the fuel supply bowl volume; and a flexible, manually operable dome means for abruptly varying the volume of said chamber and displacing a discrete volume of air from said chamber through said passageway into said bowl, said dome means including a nipple having a vent aperture therein for admitting air into said priming chamber; and a splash shield means in said body for preventing fuel from splashing upwardly from said fuel supply bowl into said passageway.

9. The carburetor of claim 8 wherein said priming aperture in said sloping surface is at substantially right angles to the vent aperture in said dome means.

10. The carburetor of claim 8 wherein said priming aperture in said sloping surface is generally elliptical in shape.

11. The carburetor of claim 8 wherein said priming aperture in said sloping surface is located in an upper portion of said chamber.

* * * * *

UNITED STATES PATENT AND TRADEMARK OFFICE

CERTIFICATE OF CORRECTION

PATENT NO. : 4,679,534

DATED : July 14, 1987

INVENTOR(S) : Thomas G. Guntly and Curtis L. Schultz

It is certified that error appears in the above-identified patent and that said Letters Patent is hereby corrected as shown below:

Claim 1, Col. 7, line 26-27, delete "surface in said chamber perpendicularly adjoining".

Signed and Sealed this

Tenth Day of November, 1987

*Attest:*

DONALD J. QUIGG

*Attesting Officer*

*Commissioner of Patents and Trademarks*